US005186654A

United States Patent [19]

Enomoto et al.

[11] Patent Number: 5,186,654

[45] Date of Patent: Feb. 16, 1993

[54] RETENTION SYSTEM FOR ELECTRICAL CONNECTORS ON PRINTED CIRCUIT BOARDS

[75] Inventors: Masahiro Enomoto, Tokyo, Japan; Arvind Patel, Naperville; Jack J. Schafer, LaGrange, both of Ill.

[73] Assignee: Molex Incorporated, Lisle, Ill.

[21] Appl. No.: 850,190

[22] Filed: Mar. 11, 1992

[51] Int. Cl.[5] ..... H01R 13/60

[52] U.S. Cl. ..... 439/570; 439/83

[58] Field of Search ..... 439/83, 562, 563, 566, 439/570, 571

[56] References Cited

U.S. PATENT DOCUMENTS

| | | | |
|---|---|---|---|
| 3,803,533 | 4/1974 | Taplin | 439/571 X |
| 4,629,278 | 12/1986 | Norton et al. | 339/134 |
| 4,645,287 | 2/1987 | Olsson | 339/125 |
| 4,826,442 | 5/1989 | Douty et al. | 439/92 |
| 4,943,244 | 7/1990 | Teck et al. | 439/571 X |
| 5,096,440 | 3/1992 | Katsumata | 439/566 X |

*Primary Examiner*—Eugene F. Desmond
*Attorney, Agent, or Firm*—Stephen Z. Weiss

[57] ABSTRACT

A retention system is provided for an electrical connector mountable to a printed circuit board. The connector is elongated and has opposite ends and elongated sides extending therebetween. At least one retention member is provided for securing the connector to the printed circuit board. The retention member includes a generally U-shaped portion defining a pair of leg sections extending in the longitudinal direction of the connector generally parallel to the printed circuit board, and a bight section joining the leg sections generally perpendicular to the printed circuit board. A recess is provided in one elongated side of the connector complementarily shaped for receiving the U-shaped portion of the retention member inserted into the recess from one side of the connector. A bottom one of the leg sections is roughened and generally planar for surface mounting to the printed circuit board, with the recess being open at the bottom thereof for exposing the bottom leg section.

10 Claims, 2 Drawing Sheets

RETENTION SYSTEM FOR ELECTRICAL CONNECTORS ON PRINTED CIRCUIT BOARDS

FIELD OF THE INVENTION

This invention generally relates to the art of electrical connectors and, particularly, to a retention system for retaining an electrical connector mountable to a printed circuit board.

BACKGROUND OF THE INVENTION

It is well known to provide electrical connectors mountable to a printed circuit board, with contact terminals therein electrically coupled to respective electrical circuit traces on the board. The terminals may have solder tails projecting from the connector and inserted into holes in the board, or the terminals may have leg portions generally parallel to the board for surface mounting in electrical engagement with the circuit traces on the board. In either instance, the terminals are coupled to the circuit traces on the board most commonly by solder connections, either between the solder tails and plated through-holes in the board or between the surface mounted leg portions and the circuit traces on the board surface.

One of the problems with electrical connectors mounted to a printed circuit board is that the electrical connections between the contact terminals and the board circuits often are subjected to stresses which can weaken or destroy the electrical connections. This is particularly true with the most common type of electrical connectors mountable to printed circuit boards, wherein the connectors are elongated in configuration to provide one or more rows of contact terminals.

Heretofore, such elongated electrical connectors often have been secured to the printed circuit board by screws, bolts or other clamping devices. However, with the ever-increasing miniaturization of electronic circuitry, along with the consequent reduction in sizes of the connectors and terminals, such clamping devices often are impractical and neither cost nor space effective. Consequently, various types of clips or brackets have been used which, themselves, may be secured to the surface of a printed circuit board by a substantial soldered area. Most such clips or brackets are mounted onto the outside of an electrical connector and often provide support between the connector and the printed circuit board in a direction transversely of the elongated connector. However, in compact electronic environments, exterior brackets or mounting clips are difficult to assemble to the connector and do not provide sufficient support between the connector and the printed circuit board in the longitudinal direction of the connector. This invention is directed to solving the problems set forth above by providing a retention system wherein one or more retention members are easily mounted within the connector from the outside thereof and which provide support between the connector and the printed circuit board longitudinally of the elongated connector.

SUMMARY OF THE INVENTION

An object, therefore, of the invention is to provide a new and improved retention system for an electrical connector mountable to a printed circuit board.

Generally, the electrical connector is elongated and has opposite ends and elongated sides extending therebetween. At least one retention member is provided for securing the connector to the printed circuit board.

Specifically, the invention contemplates that the retention member include a generally U-shaped portion defining a pair of leg sections extending in the longitudinal direction of the connector generally parallel to the printed circuit board, and a bight section joining the leg sections generally perpendicular to the printed circuit board. Recess means are provided in one elongated side of the connector complementarily shaped for receiving the U-shaped portion of the retention member inserted thereinto from one side of the connector.

In the preferred embodiment of the invention, a bottom one of the leg sections is generally planar for surface mounting to the printed circuit board. The recess means is open at the bottom thereof for exposing the bottom leg section. The upper leg section includes barb means for press fitting into the recess means. Preferably, a pair of the retention members and respective recess means are located adjacent respective opposite ends of the connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
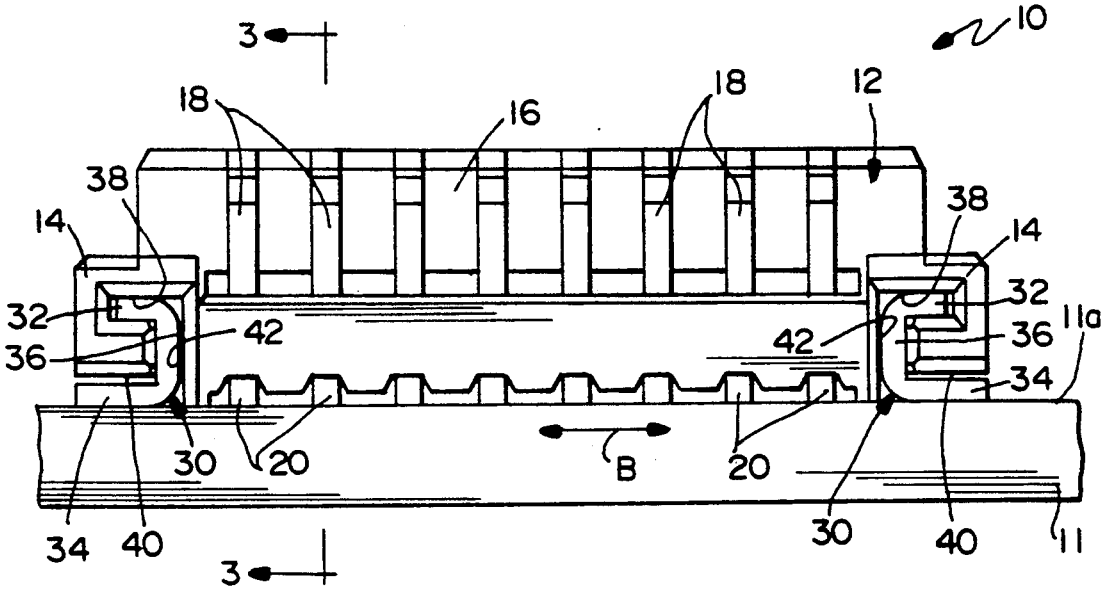
FIG. 1 is a side elevational view of an electrical connector embodying the concepts of the inventions.

Referring to the drawings in greater detail, and first to FIG. 1, the retention system of the invention is illustrated as embodied in an electrical connector, generally designated 10, solderable to the solder pad on a printed circuit board 11 having circuit traces on a top surface 11*a* of the board, as is well known in the art. It should be understood that such terms as "top", "bottom" and the like as used herein and in the claims hereof is not intended to be limiting but are used for reference purposes only since the electrical connector is omnidirectional in use depending on a particular application, as is known.

Connector 10 is elongated and includes a dielectric housing, generally designated 12, defining opposite ends 14 and elongated sides 16 extending therebetween. The housing mounts two rows of contact terminals 18 (FIG.

1) for appropriate interengagement with the terminals of a complementary mating connector (not shown).

Figure 2:
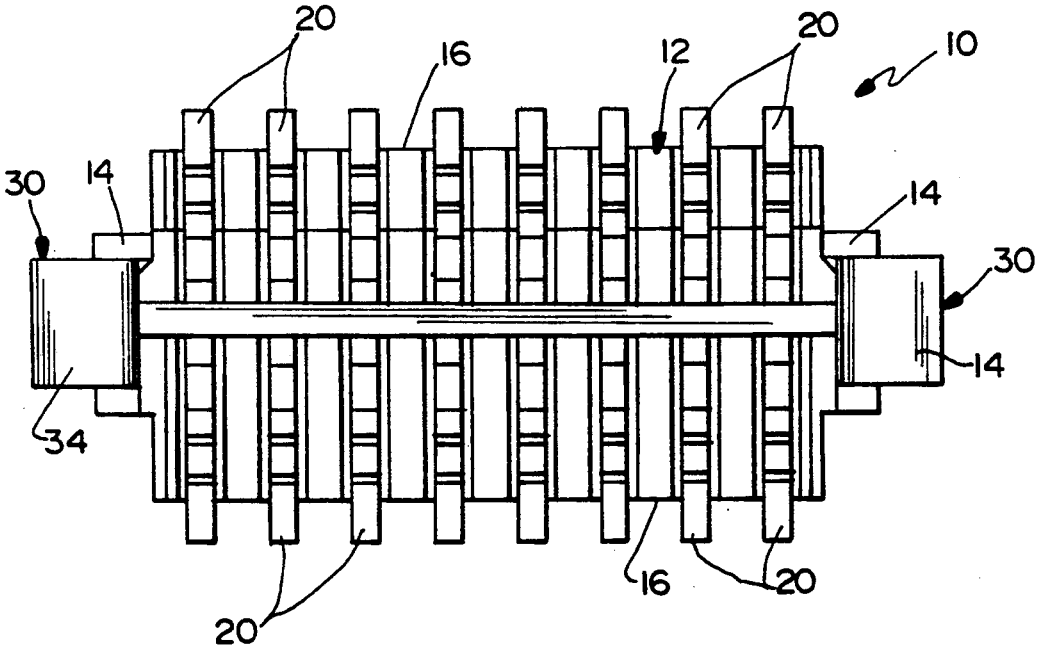
FIG. 2 is a bottom plan view of the connector.
Figure 3:
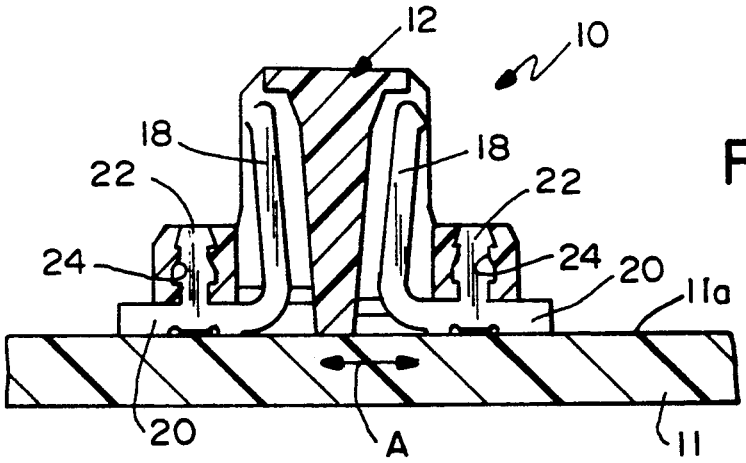
FIG. 3 is a vertical section taken generally along line 3—3 of FIG. 1.
Figure 5:
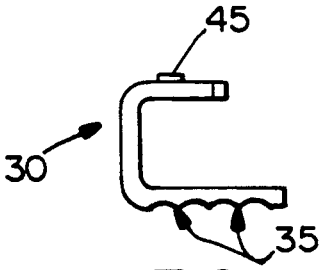
FIG. 5 is a side elevational view of an alternate embodiment of the retention member.

Referring to FIG. 3 in conjunction with FIGS. 1 and 2, each terminal 18 has a generally horizontal leg portion 20 for electrical engagement with appropriate circuit traces on top surface 11*a* of printed circuit board 11. Barbed tongues 22 project upwardly from leg portions 20 to secure the terminals, by an interference fit within holes 24 in dielectric housing 12. Leg portions 20 are electrically coupled to respective circuit traces on top surface 11*a* of printed circuit board 11 by soldered connections. It can be seen best in FIGS. 2 and 3 that leg portions 20 of the terminals are elongated in a direction transversely of the elongated electrical connector 10. Therefore, the soldered connections between the leg portions and the printed circuit board provide ample support against stresses exerted between the connector and the board transversely of the connector as indicated by double-headed arrow "A" in FIG. 3. However, should the connector be subjected to stresses longitudinally of the connector, as indicated by double-headed arrow "B" in FIG. 1, the soldered connections between leg portions 20 and the circuit traces on the printed circuit board could be damaged or destroyed.

In order to solve this problem, the invention contemplates that at least one retention member, generally designated 30 (FIGS. 1, 2, 5 and 6), be provided to retain connector 10 securely on printed circuit board 11 and provide support for the connector in its longitudinal direction.

More particularly, as seen best in FIG. 1, a pair of retention members 30, preferably, are mounted within opposite ends 14 of connector housing 12. Each retention member includes a generally U-shaped portion defining a pair of leg sections 32 and 34 extending in the longitudinal direction of the connector generally parallel to the printed circuit board, and a bight portion 36 joining the leg sections generally perpendicular to the printed circuit board.

Each retention member 30 is mounted in a complementarily U-shaped recess means in one elongated side of connector housing 12, specifically in opposite ends 14 of the connector housing. Each recessed means includes a top slot portion 38, a bottom recess area 40 and a vertical slot portion 42. Top slot portion 38 receives upper leg section 32 of the respective retention member 30, bottom recessed area 40 receives lower leg section 34 of the respective retention member and vertical slot portion 42 receives bight portion 36 of the respective retention member. Recessed area 40 is open at the bottom of the housing for exposing bottom leg section 34 of the retention member as seen in FIGS. 1 and 2. Bottom leg section 34 is generally planar and has a substantial area as best seen in FIG. 2. The bottom surface of leg section 34 is soldered to a solderable pad of at least equal area on top surface 11*a* of printed circuit board 11. As an alternate embodiment, the bottom surface 34 is roughened to improve its ability to adhere to the solder pad. The preferred roughened surface includes parallel rounded flutes 35. However, the bottom surface 34 can also be roughened by serrations taking many different forms.

With the above description of retention members 30 and recess means 38–42, it can be understood that bottom leg sections 34 of the retention members secure the connector perpendicular to the printed circuit board and bight sections 36 of the retention members, press-fit into slot portions 42, secure the connector against stresses longitudinally of the connector as indicated by double-headed "B" (FIG. 1). In addition, it can be seen that the retention members are inserted into recess means 38–42 in one of the elongated sides of the connector (the side visible in FIG. 1), whereby the retention members are encapsulated completely within the bounds of the connector housing. Upper leg sections 32 of the retention members prevent the connector from being lifted off of the printed circuit board.

Figure 4:
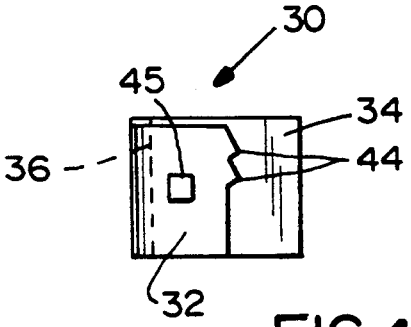
FIG. 4 is a top plan view of the right-hand retention member as seen within the connector as viewed in FIG. 1.
Figure 6:
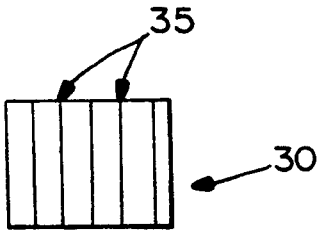
FIG. 6 is a bottom plan view of the alternate embodiment of the retention member in FIG. 5.
Figure 7:
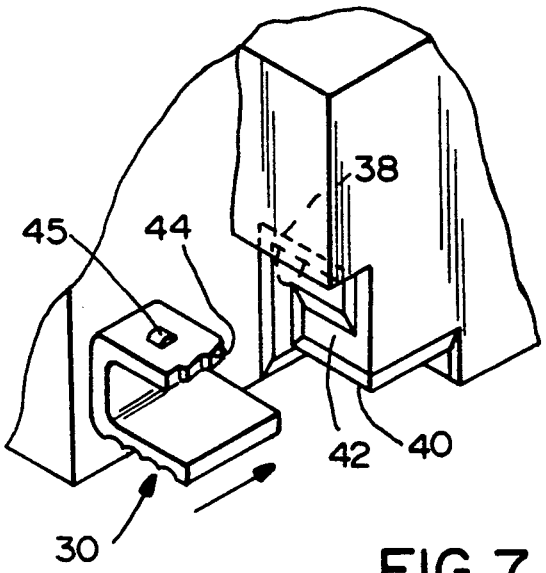
FIG. 7 is an isometric view of the right hand retention member as viewed in FIG. 1.

Referring to FIG. 4, which is a top plan view of the right-hand retention member 30 as viewed in FIGS. 1 and 2 and FIG. 7 which is an isometric view of the same, an outer edge of upper leg section 32 of the retention member is provided with a plurality of barbs 44 for establishing an interference fit within slot portion 38 of the respective recess means in the right-hand end 14 of connector housing 12. A boss 45 is provided in the center of the upper leg section 32 establishing an interference fit between the upper and lower walls of slots portion 38 between the boss and the lower wall and upper leg section 32. It should be understood that the left-hand retention member as viewed in FIGS. 1 and 2 is a mirror image of the right-hand retention member. Barbs 44 and boss 45 securely retain the retention members within the recess means of the connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a retention system for an electrical connector mountable to a printed circuit board, including an elongated electrical connector having opposite ends and elongated sides extending therebetween, and at least one retention member for securing the connector to the printed circuit board, wherein the improvement comprises said retention member including a generally U-shaped portion defining a pair of leg sections extending in the longitudinal direction of the connector generally parallel to the printed circuit board and a bight section joining the leg sections generally perpendicular to the printed circuit board, and recess means in one elongated side of the connector complementarily shaped for receiving the U-shaped portion of the retention member inserted thereinto from one side of the connector.

2. In a retention system as set forth in claim 1, wherein a bottom one of said leg sections is adapted for securement to the printed circuit board.

3. In a retention system as set forth in claim 2, wherein said bottom leg section is generally planar for surface mounting to the printed circuit board.

4. In a retention system as set forth in claim 3, wherein the other leg section includes barb means for press fitting into said recess means.

5. In a retention system as set forth in claim 1, including a pair of said retention members and respective recess means located adjacent respective opposite ends of the connector.

6. In a retention system as set forth in claim 1, wherein an upper one of said leg sections includes barb means for press fitting into said recess means.

7. In a retention system as set forth in claim 1, wherein an upper one of said leg sections includes boss means for press fitting into said recess means.

8. In a retention system as set forth in claim 1, wherein a bottom one of said leg sections is generally planar for surface mounting to the printed circuit board, and said recess means is open at the bottom thereof for exposing the bottom leg section.

9. In a retention system as set forth in claim 3, wherein said generally planar surface is roughened.

10. In a retention system as set forth in claim 9, wherein said generally planar roughened surface has flutes formed therein perpendicular to the longitudinal direction of the connector.

* * * * *